US006634994B2

(12) United States Patent
Reid et al.

(10) Patent No.: US 6,634,994 B2
(45) Date of Patent: Oct. 21, 2003

(54) JUMP ROPE DEVICE

(75) Inventors: Tahira Reid, Troy, NY (US); Burt Swersey, Stephentown, NY (US); Paul Fiscarelli, Portsmouth, NH (US); Rory MacKean, West Newburgh, MA (US); Joe Doucette, Waltham, MA (US); Lakisha Anderson, Hartford, CT (US); Maneesh Shrivastav, Pontiac, IL (US); Colleen Conlon, Brookline, MA (US); Thomas Manning, Catskill, NY (US); Kevin Haynes, Dalton, MA (US); Serge Rigaud, Rosedale, NY (US); Eileen Carrier, Bronx, NY (US); William Foley, Clifton Park, NY (US)

(73) Assignee: Rensselaer Polytechnic Institute, Troy, NY (US)

( * ) Notice: Subject to any disclaimer, the term of this patent is extended or adjusted under 35 U.S.C. 154(b) by 0 days.

(21) Appl. No.: 09/801,162

(22) Filed: Mar. 7, 2001

(65) Prior Publication Data

US 2002/0123413 A1 Sep. 5, 2002

(Under 37 CFR 1.47)

Related U.S. Application Data

(60) Provisional application No. 60/187,922, filed on Mar. 8, 2000.

(51) Int. Cl.[7] ..... A63B 5/20

(52) U.S. Cl. ..... 482/81; 482/82

(58) Field of Search ..... 482/81, 82

(56) References Cited

U.S. PATENT DOCUMENTS

| | | | | | |
|---|---|---|---|---|---|
| 4,529,195 | A | * | 7/1985 | Stevens | 482/81 |
| 4,813,665 | A | * | 3/1989 | Carr | 482/81 |
| 5,005,828 | A | * | 4/1991 | Sauerbrey | 482/17 |
| 5,520,595 | A | * | 5/1996 | Lee | 482/17 |
| 5,888,179 | A | * | 3/1999 | Singhal | 482/81 |
| 5,961,425 | A | * | 10/1999 | Reid et al. | 482/81 |

* cited by examiner

*Primary Examiner*—Glenn E. Richman
(74) *Attorney, Agent, or Firm*—Francis C. Hand; Garella, Byrne, Bain et al.

(57) ABSTRACT

The jump rope device employs DC motors to rotate two ropes and a dual closed loop control system is used to synchronize the turning movements of the two ropes. An infrared beam is used to monitor the use of the machine by a user. Each motor housing is mounted on a tripod support which can be collapsed for ease of transportation and storage. A floor mat with sensors may be employed for various exercises.

9 Claims, 8 Drawing Sheets

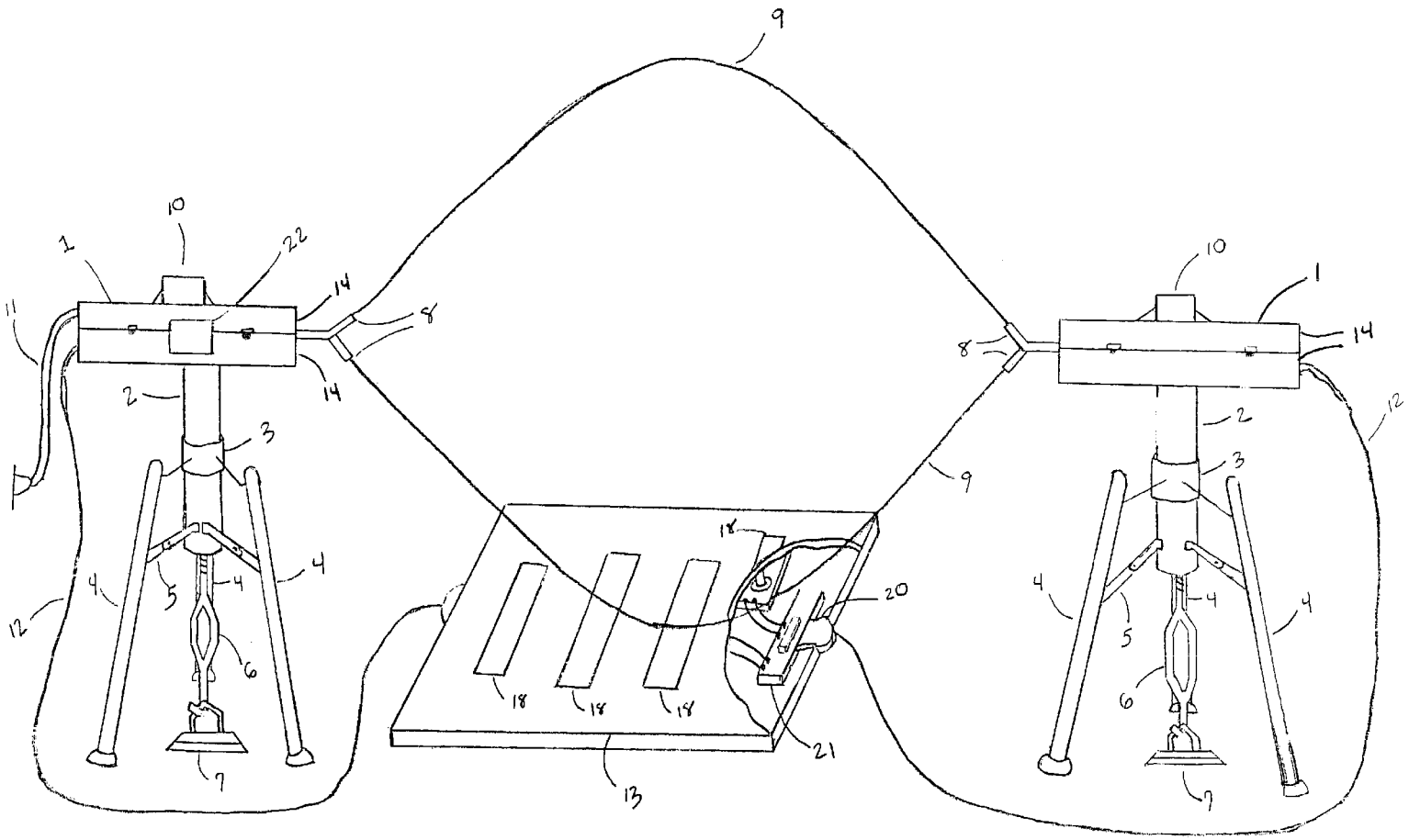
FIG. 1 - Side View

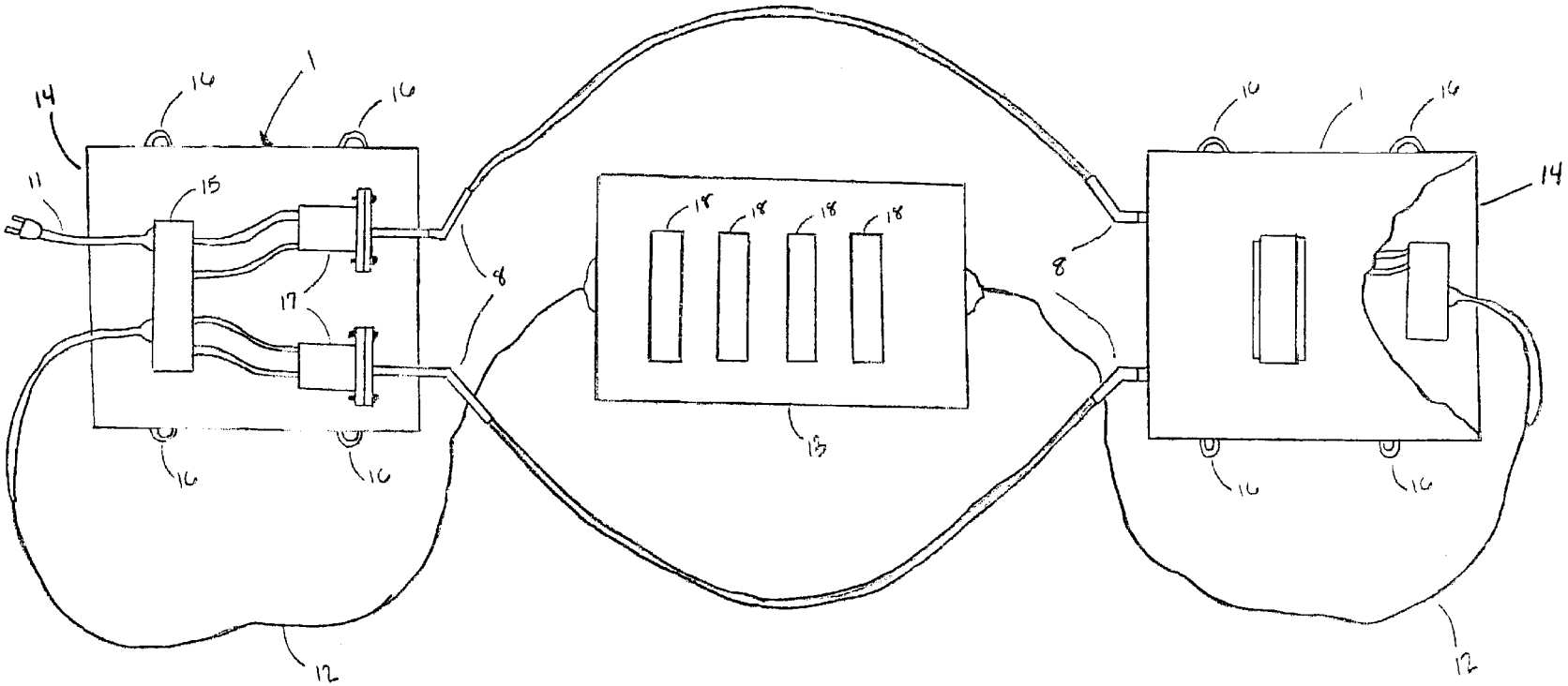
FIG. 2 - TOP VIEW

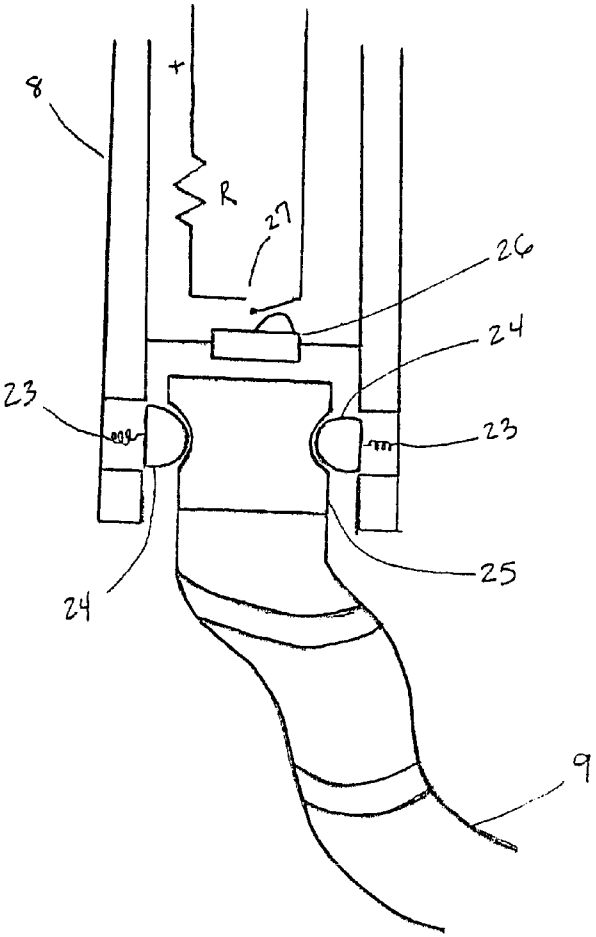
FIG. 3 - ROPE RELEASE

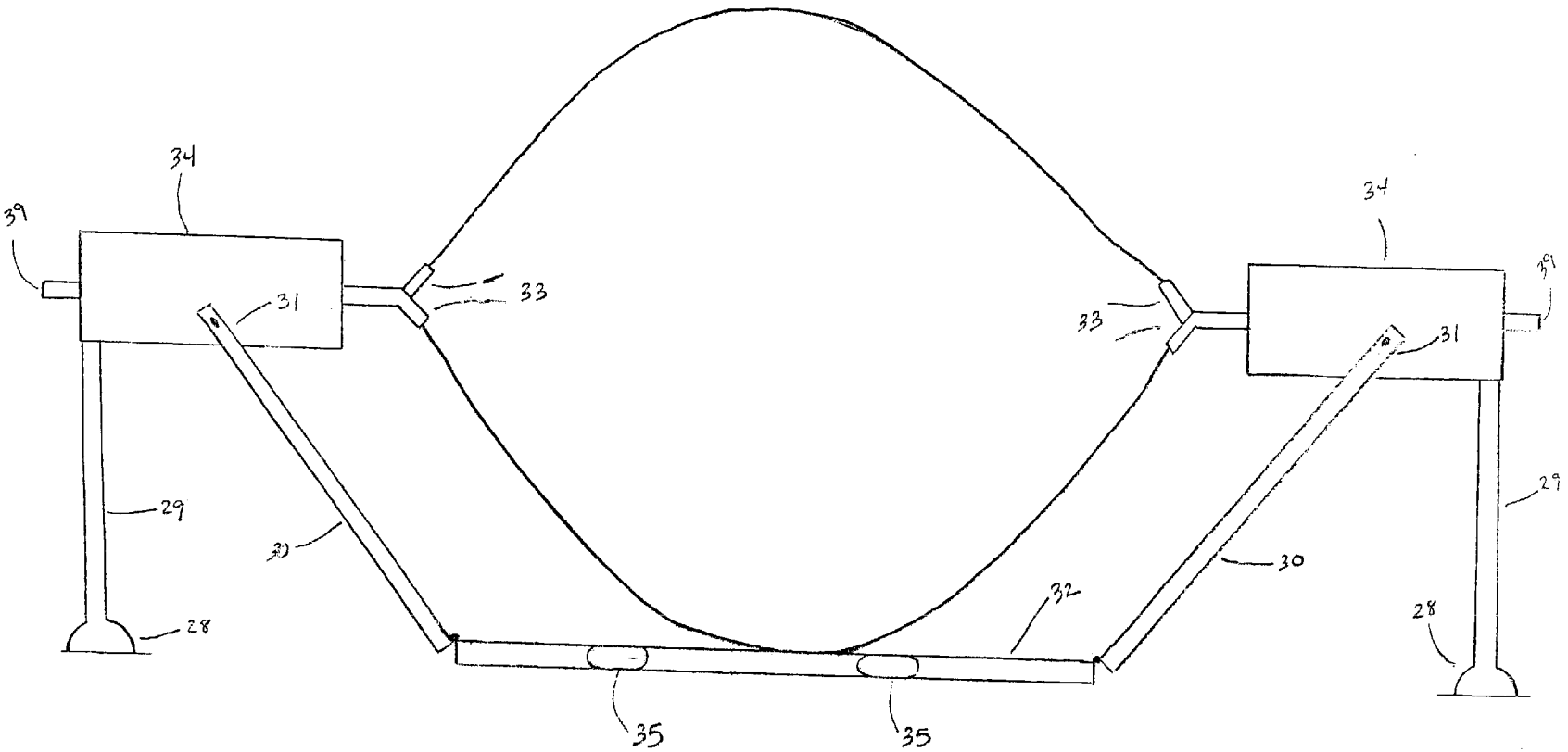
FIG. 4 - SIDE VIEW

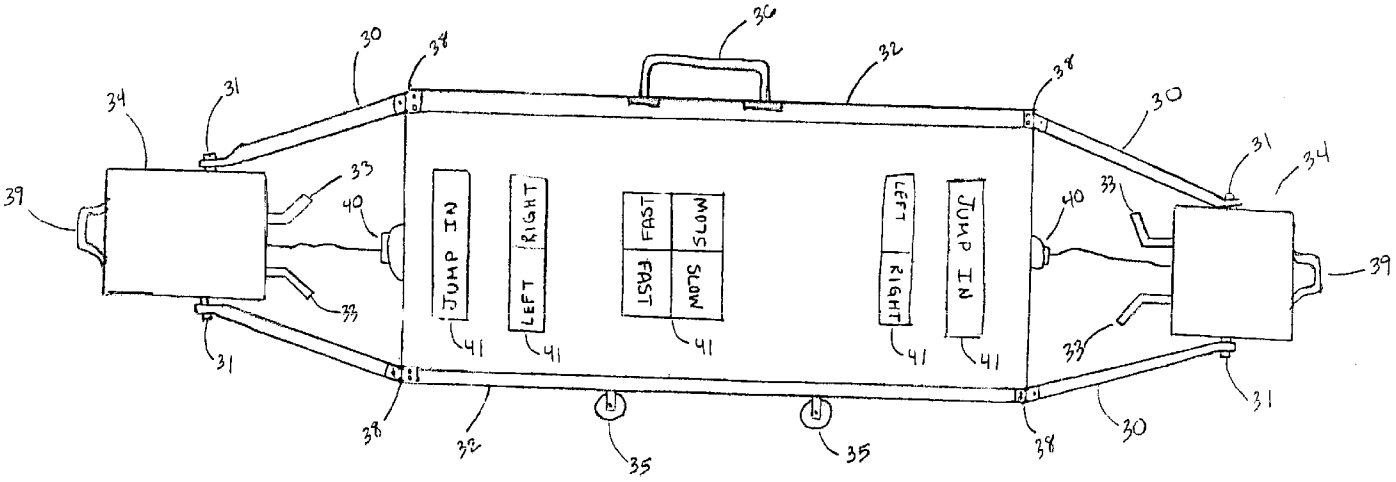
FIG. 5 - TOP VIEW
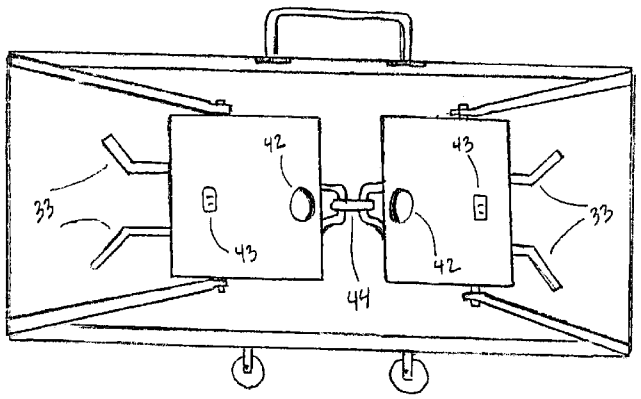
Folded Down

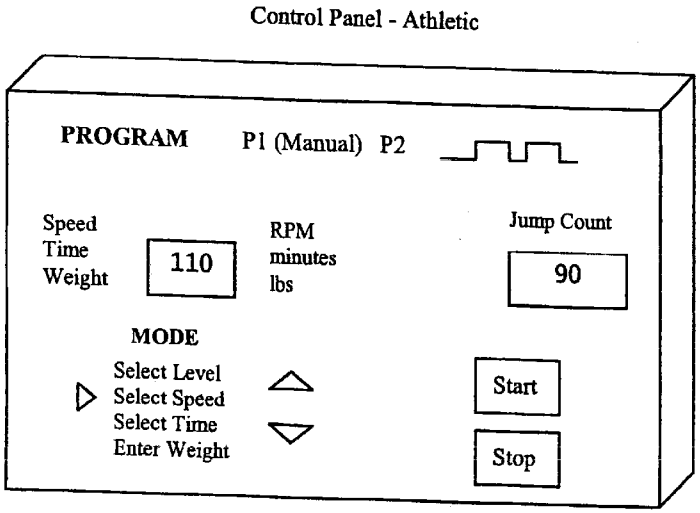
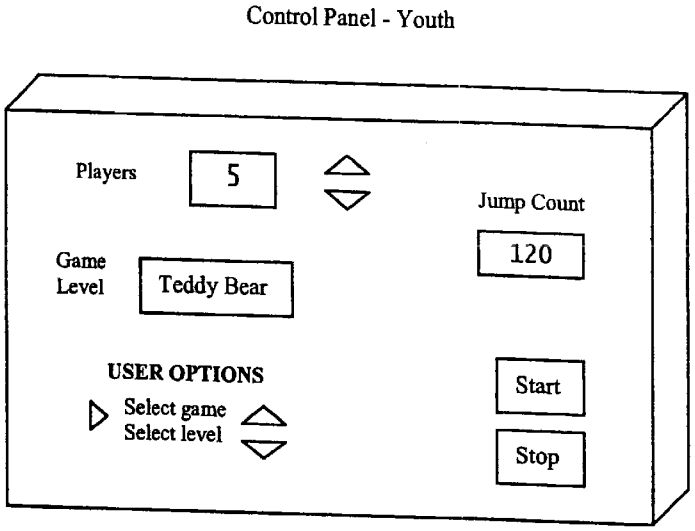
FIG. 6 – Control Panels

Fig. 7- Youtn
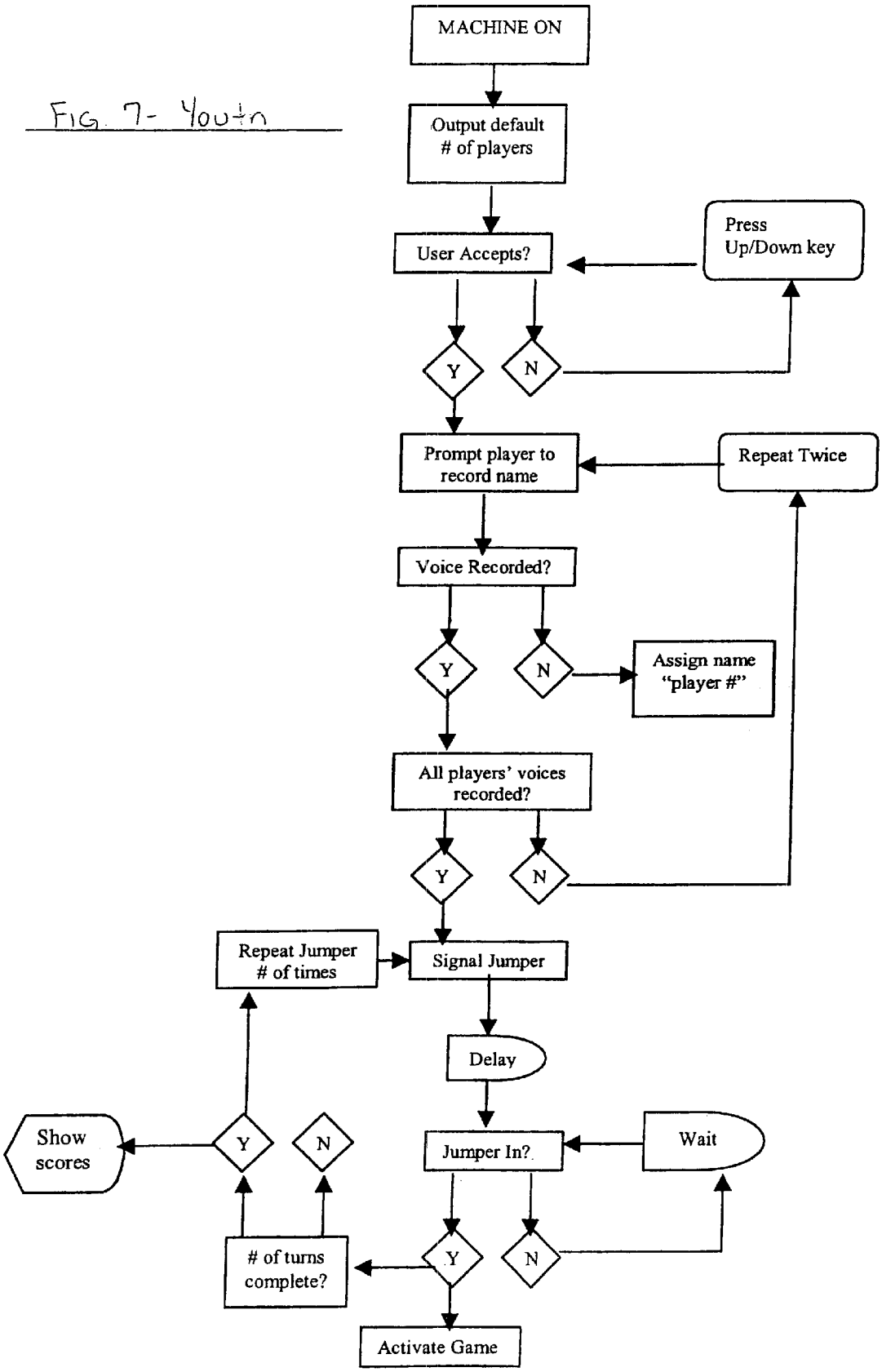

FIG. 8 - Athletic
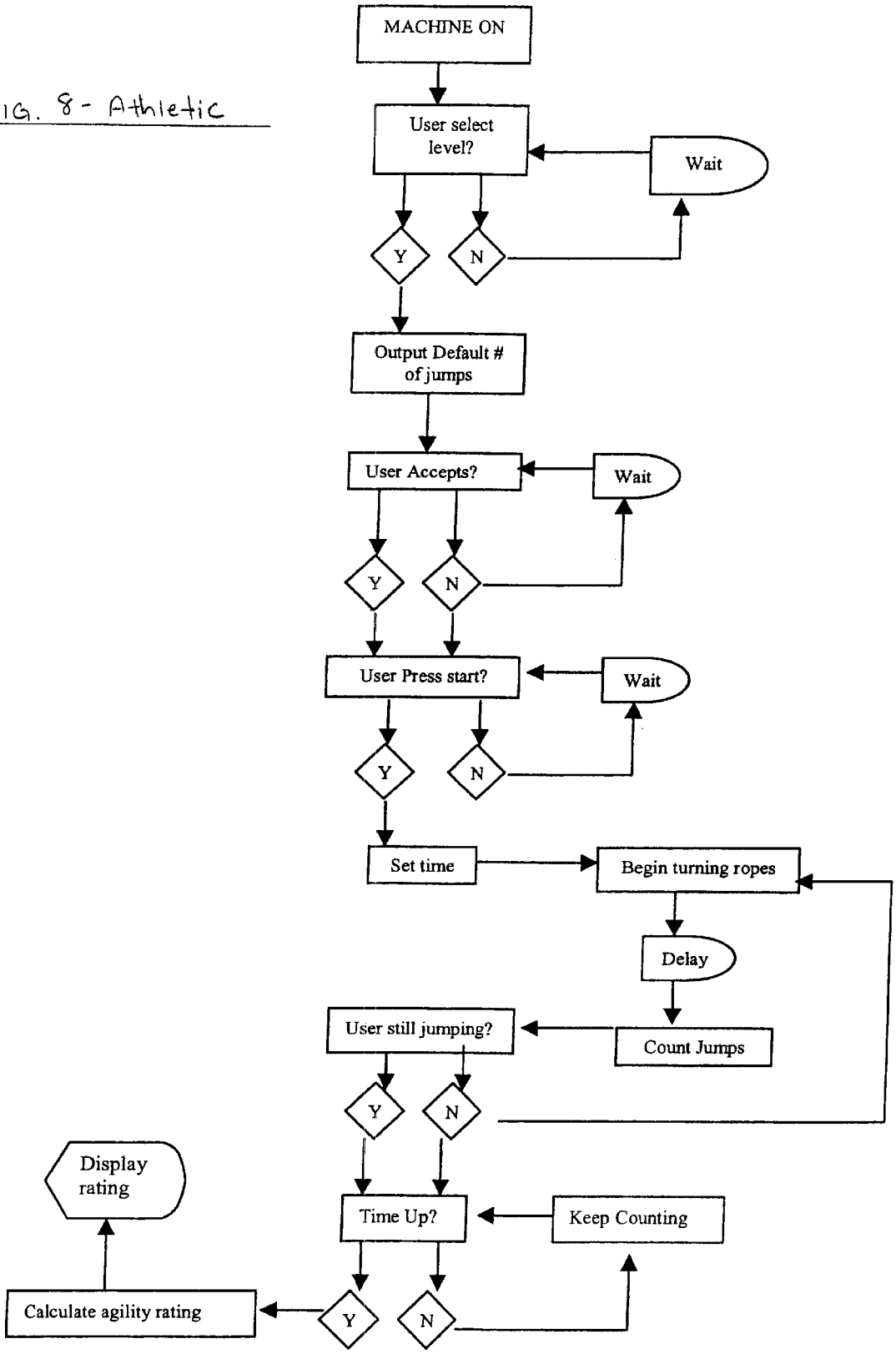

JUMP ROPE DEVICE

This application claims the benefit of Provisional Application No. 60/187,922, filed Mar. 8, 2000.

RELATED APPLICATION

This application is an improvement of the device described in U.S. Pat. No. 5,961,425.

TECHNICAL FIELD OF INVENTION

The present invention relates to the field of recreation and physical fitness, to a device that allows participants to jump rope in the absence of other individuals if they so desire and more particularly to the activity of Double Dutch jump roping.

BACKGROUND OF THE INVENTION

Double Dutch jump roping is a fun activity that requires skill. The activity is mainly played for recreation and for competitions. Industry has neglected to see the vast number of benefits in this activity which includes enhancing the cardiovascular system, improving coordination and agility, and it is generally a very entertaining activity. The main limitation in the sport is that much of the skill comes from being able to turn the ropes.

Accordingly, it is an object of the invention to provide a simple jump rope device for turning a pair of ropes in an out-of-phase relation with an improved synchronization method.

It is another object of the invention to employ a simple yet effective means for powering a double dutch jump rope machine and for disengaging the ropes when a user steps on or interrupts the ropes.

It is another object of the invention to implement a means for inexperienced jumpers to learn and participate in a double dutch jumping activity.

It is another object of the invention to develop a more robust means for controlling the operation of a jump rope machine by the use of embedded controls.

It is another object of the invention to add more functions to an existing jump rope machine for uses in a variety of settings such as in fitness centers, competitive teams, and for children.

SUMMARY OF INVENTION

Briefly, the invention is directed to a jump rope device as described in U.S. Pat. No. 5,961,425 as well as other jump rope devices. As described, the jump rope device consists of two identical stations, each having a stepper motor to drive a pair of parallel rotatable shafts and a transmission connecting the shafts together to rotate in opposite directions. Each of the shafts rotates a pair of arms that thus turn ropes connected to them. For safety purposes, a release means is used to address situations where the user would step on the rope or interrupt the rope's rotation.

In accordance with the invention, a jump rope machine as described in U.S. Pat. No. 5,961,425 is provided with a safety release means where the ropes are connected and which will become detached from the machine when a user steps on a rope or interrupts the rotation of a rope.

A control panel is included (or built into one of the stations) and provides the user with options such as speed and difficulty level among other things.

In short, the basic jump rope machine is provided with improvements in the drive system, the manner for attaching and rotating the ropes, the controls system, safety features and supports.

BRIEF DESCRIPTION OF DRAWINGS

FIG. 1 is a side view of one embodiment of the jump rope device showing the ropes in full swing;

FIG. 2 illustrates a partial plan view of the device of FIG. 1;

FIG. 3 illustrates a rope release mechanism that has a kill switch to cut off power to the motors;

FIG. 4 illustrates a side view of a modified embodiment of the jump rope machine in accordance with the invention;

FIG. 5A illustrates a partial plan view of the device of FIG. 4;

FIG. 5B illustrates a plan view of the device of FIG. 5A in a folded down condition;

FIG. 6A illustrates a front view of a control panel for the athletic user embodiment;

FIG. 6B illustrates a front view of a control panel for the youth user embodiment;

FIG. 7 is a flow diagram that displays how the program will work for a youth model; and FIG. 8 is a flow diagram that displays how the program will work for an athletic model.

DETAILED DESCRIPTION OF THE INVENTION

In the embodiment of FIG. 1, the ropes 9 are attached to a rotating mechanism 8. The rotating mechanism 8 is bent on an angle to aid in the formation of the rope 9 arcs that are shown. Each station 14 is supported on a tri-pod 2 stand. The trip-pod 2 is designed such that it can be detached and folded down for storage. A collar 3 on the tri-pod 2 slides up and down causing the joint like hinges 5 to fold and the legs 4 to collapse. For additional support to the tri-pod 2, a turnbuckle 6 is attached to a suction cup 7. This embodiment is specifically for smooth surfaces such as gym floors. Those skilled in the art should recognize that the turnbuckle 6 and suction cup 7 assemblies could be replaced with various other means for adding additional support or anchoring to the system. Some examples include: a rod that screws into a gym floor or playground surfaces, a stake that can be dug into dirt or grassy surfaces.

Those also skilled in the art should see that the overall support system could be replaced with a number of other supports means for supporting the system. A footpad 13 that contains several panels 18 that make contact with switches 19 located below the surface. Each switch 19 is connected to a circuit 21 containing a microcontroller chip that reacts to each switch 19 that is activated. A length of cord 12 is connected between each station 1 and the foot pad 13 to ensure that it receives power and electronic information is communicated. A user control panel 22 is attached to the housing so that the user can select games and adjust settings.

Referring to FIG. 2, the motors 17 are contained in a housing structure 14. The housing 14 is comprised of a top and bottom half that are attached by the connection means 16 with appropriate fasteners. A display means 10 is located on top of housing 14 that will provide the user with information such as the number of jumps and agility levels. The system receives power using an AC cord 11 which is then converted by the circuit 15 to DC power. Those skilled in the art should recognize that the system could be powered using appropriate rechargeable batteries or a power supply and that the cord can be eliminated and replaced with an optical or radio means for having the two stations communicate with one another. Examples include RF or IR transmitter and receiver circuits with the appropriate supporting components to ensure communication between the two stations.

The circuit 15 consists of a microcontroller that controls the position and speed of the motor, user options, the display means 10, and all the actions of the sensors.

FIG. 3 shows the embodiment of a rope release mechanism located in the rotating mechanisms 8. The rope 9 has female connector end 25 that is inserted into the rotating mechanism 8 and pushes against a spring loaded 23 male attachment 24. This ensures that the rope 9 stays in place until a force strong enough causes it to release. The female connector end 25 also pushes against a button 26 that closes an open circuit 27 to ensure that power will go to the motor. When a strong enough force causes the rope 9 to release, it will open the switch and cut off power to the motors.

FIGS. 4, 5A and 5B show a modified version of the invention. Support means consists of a leg 29 with a suction cup 28 used for added support and extended legs 30 that connect to a length of tubing 32. The extended legs 30 are connected to the housing 34 through a pin 31. The pin allows the housing structure to rotate backwards and forwards so that it can be folded down as in FIG. 5B. Hinges 38 join the extended legs 30 and length of tubing 32. A platform 37 is contained in this framework and is made of material appropriate for high impact exercise on the knees. The platform 37 contains panels 41 that make contact with switches beneath its surface. It is configured the same as the footpad depicted in FIG. 1. The power from one station 34 to the other is connected through cord 40 that is plugged into the platform 37. The cord 40 is specifically plugged into a socket 43 in the bottom of the station 34. Although not shown, the device would use AC power and use a configuration like that of FIG. 1. A handle 36 aids a user with rolling away the device on wheels 35 when in a folded position. Once folded down, two hooks 39 can be locked with a fastening means 44.

FIG. 6A displays a controls panel appropriate for an athletic model and FIG. 6B displays a controls panel appropriate for a youth model.

Drive System

The drive system consists of a pair of motors 17 on each station 14 without the use of any means for a transmission. Having a motor 17 on each side of a swinging rope 9 (turning in the same direction) ensures an arc that is symmetrical. Each motor pair 17 and rope 9 will turn in opposite directions simulating the Double Dutch motion. This provides a more realistic feel for the jumper and allows jumpers to jump in on either end of the device without having to adjust to the rope being rotated about one point. This would be the case if one end of the rope were fixed. This also ensures that the arc is shaped more like a parabola, as one would expect from a human turner.

Having the ropes independently actuated allows for even more freedom and allows for a simpler method of adjusting width between ropes. The main advantage, however, is that independent actuation allows the machine to start the arcs as a human turner does—one rope before the other and also allows the user to jump single rope in a more effective manner.

In addition, one skilled in the art would recognize that a mechanical transmission means could be added to the system to eliminate the need for four motors similar to that of U.S. Pat. No. 5,961,425. Instead of using the pulley and belt arrangement, one could use a single DC gear head motor and a pair of gears. The motor would directly drive one of the gears, which in turn drives the other gear in the opposite direction. This gear rotation would effectively simulate the Double Dutch motion.

Controls System

The purposes for the controls system are to synchronizing the ropes and control the speed. Another use of the control system is to provide specific programs for the different models that will be discussed.

One of the problems encountered while improving the previously patented device was spinning two ropes at precisely the same speed. Employing a dual closed-loop control system solved this problem. In a closed-loop control system, feedback is used to vary a desired input signal. For the gear embodiment, a microcontroller can be used to generate two Pulse Width modulated signals (one for each motor). These two signals are passed on to each DC motor via high power DC drive circuits. The duty cycle (on/off time) of each PWM signal is amplified by the DC drive circuits and thus controls the desired speed of each DC motor.

The feedback in the closed-loop systems is provided by a pulse-coded system incorporated into the gearing system. As the motor turns the gear, a series of holes in the gear revolve through a photogate circuit comprising an infrared emitter/detector pair. The photogate circuit in turn generates a series of pulses that are fed back into the microcontroller. This microcontroller determines the speed of the motors by dividing the number of pulses by a certain period of time. After calculating the motor speed, the microcontroller uses the values in a control algorithm along with desired motor speed, to compute new PWM signals to be fed back into the DC motors. With this type of control system, one can ensure that both motors turn at exactly the same speed. This same method can be applied to the preferred embodiment consisting of four motors. One would just have to ensure four PWM signals were generated and use appropriate encoders for each motor. One could also use motors that are already equipped with an encoder.

Controls-Embedded Electronics

The electronics in the jump rope device are run off of a Motorola 68HC11 microcontroller. This architecture was chosen because of its generous number of digital and analog inputs and outputs. One skilled in the art would recognize that the Motorola microcontroller could be replaced with a PIC chip or other standard industry microcontrollers.

The microcontroller controls the operation of the machine. Inputs are given to the system via a control panel located on one of the bases (or mounted separately). The user selects one of a number of predefined programs, selects a speed/time etc, optionally enters a weight for calorie burning calculations, hits start, does the jumping, and then the machine finishes when the user is done.

A motor controller will control the 4 motors 17 of the system. The microcontroller will achieve this via PWM (pulse width modulation), where long pulses make the motor go fast and short pulses make it go slow. Some means will be used to track the position of each motor. The preferred embodiment will use an optical encoder like device for positional tracking, using the difference in arrival times of a notch on a wheel past a light sensor to judge the alignment of the axes.

To maintain system stability, the microcontroller will retain a desired position for each of the axes, and individually adjust each motor speed so its position nears that of the desired reference point. This method of control allows the motors on each end of the rope to stay in synchronization while maintaining the proper timing between ropes over extended sessions.

Synchronization

The motor is synchronized using closed loop feedback control methods in conjunction with pulse-width modulation. There are several ways of using existing technology to implement this task. Some examples include using infrared LEDs and detectors that feed back the gear position of each station to a pre-programmed micro-controller. An algorithm in the microcontroller is used to adjust the position of the axes in milliseconds to keep them in sync throughout the session. Also, the LED detector system is used to keep count of how many times the jumper has jumped according to pre-determined axis positions. Other methods for keeping the ropes in synchronization include using the Hall effect method, which involve magnets and encoders.

The pulse generators used in the DC motor control serve a dual purpose. In this pulse generator construction, use is made of two photogates—each pair slightly offset from one another. The outer photogate is used in the DC motor speed control system and the inner photogate is used to synchronize both DC motors. Instead of using a series of holes as in the speed control system, a single hole placed in the gear to monitor the position of the rotating gear is used.

When the system is started, the microcontroller slowly turns each motor until the inner photogates are triggered by each synchronization hole. When a photogate senses a hole, a signal is sent back to the PIC chip, which in turn stops the corresponding motor. When both motors have been positioned properly, the microcontroller will start feeding the desired motor speed signals to each DC motor, thus synchronizing the speed and positioning of both motors.

The signal generated by the inner photogate is also used to count the number of revolutions in each round. This is used to keep track of the number of jumps a participant performs; each revolution corresponds to two jumps.

In addition, an electronic circuit consisting of a comparator can be used. This comparator compares the speed of each rotating gear as measured by individual electronic speedometers. The comparator, designed with operational amplifiers, adjusts voltage to one motor to match the speed of the other motor. Hence, one of the motors provides the reference and the other follows by matching the speed of the first. The speed of the reference can be directly controlled by a voltage source or a potentiometer.

Programming

A detailed program including modular functions will perform all the tasks associated with controlling the device. A system check and alignment function checks the overall system to ensure that all components are intact and the gears are in the ready position. This is part of the added safety features.

Through pulse width modulation and a closed loop feedback system, the DC motors are synchronized to turn at the same speed to ensure proper positioning and arc formation.

Control Panel/Participant Sensing

A control panel attached to the device consists of a user interface that has a means for both user input and device output. A specific panel can be applied for the intended user. A user interface can allow the user to control jump speed and set the time and pattern for an exercise routine. The interface consists of a membrane touch panel and a small display. This interface provides a number of variations in jump pattern, including ramping up or down jump speed for a set time. The interface can also be set for use with one jump rope if the user decides to detach one of the ropes.

One type of panel can allow the user to select the level they would like to use by hitting some type of switch. This switch will send a signal by some means to the circuit that will send that signal to some means of a microcontroller.

Another method for indicating when to jump into the ropes is by using a footpad that lights up in an area where your food should be at a given time. This will allow the user to focus on where they should end up once they enter the ropes.

Another task that was accomplished through electronic means was the sensing of a participant in between the twirling ropes. This was accomplished by setting up an infrared beam between the two stations. When a participant jumps into the twirling ropes, an infrared beam is broken. The microcontroller chip, which constantly monitors the beam, uses this signal to start and stop accumulating the participant's jump count.

A major problem encountered while designing the infrared circuitry was how to avoid ambient light, in particular sunlight, from interfering with the system. This was accomplished by modulating the infrared signal. Instead of staying on constantly, the infrared emitter circuit is pulsed at a certain frequency. In this embodiment, the emitter circuit was pulsed at 40,000 times per second or at a frequency of 40 kHz. This value was used because the value has been adopted as an industry standard. Also, 40 kHz infrared detectors are readily available at most electronic hobby shops. This type of circuit disregards all ambient light.

Safety Mechanisms

A method for ensuring that the jumper is safe during times of mistakes involves using a remote control safety switch. Industry sometimes refers to this name as the "dead man's switch". While jumping, the user holds a small switch that is used as a remote control for the jump rope device. The switch should be palm sized to reduce if not eliminate any interference that holding a switch may pose on the concentration of the jumper. While jumping, the jumper creates a closed circuit squeezing the remote control. If the jumper is to fall or become tangled, he or she can simply release (drop) the remote and the jump rope device will detect that the circuit on the remote is no longer closed. After sensing this by some means such as an infrared receiver, the motors would stop. This provides another level of safety on the device.

A rope release mechanism that is shown in FIG. 3 consists of a female and male connector pair that is held in place under a spring load. The female connector pushes against a switch that completes a circuit to ensure that the motors will run. When user steps on the rope, the rope will release and cut of power to the motors as the button will not be pressed. Other means for a rope release include a ball and socket connection.

Supports

The overall machine can be supported with a platform and pole assembly. For stability, this platform can be filled with sand or water. This support can also be constructed to be collapsible as indicated in FIG. 1. This allows for ease of disassembly and storage. The collapsible supports are designed such that the user can fold up the device and store the device in a storage room.

Physical Fitness Model

This device can be used as an exercise machine to provide a cardiovascular workout for the user. An appropriate control panel will provide a user with options and allow the user to input their weight for fitness applications. An algorithm in the program will take the user's weight and perform a calculation that will display how many calories were burned within that particular session for that specific user.

In order to implement such a model, the base has to be designed so that aerobic or dancing activity can take place. The device will require some mechanical and/or electrical means to move the device from left to right and front to back. One possible way is to use an electromagnetic surface and a metal plate on the base of the device. The electromagnets will attract the base of the device in an area that is specifically activated. The activation would be controlled with the microcontroller in order to synchronize the activation points with tempo of the aerobics music. The embedded controls will also allow the ropes to turn at the tempos of the music by sending pulses equivalent to the pulses generated by the music's tempo or any other means. This would allow doing some aerobic moves while jumping Double Dutch. Also, the device itself can be moved this way with actuators, rack and pinions, or pneumatics.

Athletic Teams Application

For the athletic user, a control panel can be incorporated that provides feedback on the user's agility level. The control panel will use an algorithm that incorporates the number of jumps, elapsed time, jumper level (beginner to intermediate) and the number of mistakes to provide a numeric rating. One type of algorithm could be as follows: user selects level (beginner, intermediate, advanced), display panel will show a target number of jumps that has to be achieved to receive an 'A' rating on the agility. The user can also change that minimum by a designated key on the control panel. The beginner level's minimum number of jump requirements could be 30 (required jumps). The default amount of time the user gets is 1 minute. The user's agility would be calculated by taking their actual number of jumps, divide it by the target number of jumps and then multiply the result by 100%. A grade or sometime of standard message can be assigned to their result such as "Super coordinated" for those that get 90% and higher, or "Above average" for 80–90%. A similar algorithm can be implemented for a speed test. The user would get 2 minutes to demonstrate a speed test. An advanced speed jumper could achieve 400 jumps of the left foot in 2 minutes. Therefore, the RPM setting for advanced level would be 200 RPM. If the person is able to achieve the 400 left jumps in 2 minutes, their speed rating would be 100%. The calculation would be actual number of jumps divided by the target number.

The way this would work is the panel would display different levels for the user to select. It will then show a default number of jumps and the user can either accept that number or adjust it using keys on the panel. Once the user accepts it, he/she will press start. After the start button is pressed, the microcontroller program will set a delay and set the timer. The ropes would then automatically start to turn. Another delay will take place giving the jumper time to get in the ropes and the counting of jumps will begin. While the user is still jumping, the program will continually check to see if the person is still jumping and will continually count the jumps. When the jumper makes a mistake, the clock will keep running and the ropes will set up to start turning again. When the time is up, the agility of the user will be rated based on the number of jumps that was counted in that session and the number of jumps the user aimed to achieve during the time duration. By taking the actual number of jumps, dividing it by the target number of jumps and multiplying by 100%, a numeric value will tell the program which letter to assign. The grade or rating will be displayed on the output display panel.

Youth Model

The main objective of the youth model is to teach children how to jump Double Dutch and to ensure they have fun while using the machine. There is a footpad that lights up in the areas where the user's foot should land while jumping. A means of a sound, visual, and/or vibration indicator will tell the user when to jump in. Methods for employing a sound include a flashing light or the rope itself can light up. Regardless of what method is used, all the indicators have to go off when the rope is approximately 60 degrees with respect to the ground. The indicator will basically work as a function of angular position and speed. There is only one point in time when the user can jump in and that's only when the angular position is at approximately 60 degrees to the ground. By human nature, people's reaction time will not allow for entry into the rope at this exact point in time. Therefore, at a suitable RPM level, a user will need to delay their entry into the ropes. The algorithm would be designed to send a signal just when the time was right to jump.

A means for recording time efficiency, speed, and jump count will be implemented so that the user can watch their progress. If there is more than one user, a means for keeping track of whose turn can be employed. One example of doing that is by using a 2-second voice-sampling unit. An algorithm in the program that assigns a number to the recorded voice will keep track of whose turn it is. When the person's turn comes up, the device will playback the recorded name of the jumper after the previous jumper is finished.

In conjunction with keeping track of the user's turn, the jumper could also select how many turns each player can get before his or her turn is considered over. For example, the user interface will have some input buttons. Some means of showing numbers such as a digital display can be used so that the user sees how many turns are being programmed. Also as the user gets better, they can choose different levels at which to jump (beginner to advanced). A potentiometer can be employed to vary the RPM of the motors.

An algorithm in the program can take the input signal of the level button and associate the input signal with the appropriate subroutine. This subroutine in the program will output the right range of pulses to achieve that speed appropriate for that level.

The way this will work is that the user will turn on the device. It will output the default number of players. The user(s) will accept or adjust the number by using an up/down key. The panel will prompt the user to record his/her name by speaking into the microphone. A prompt will ask if all jumpers names have been recorded and will ask according to the number of jumpers selected in the first menu. Once all voices have been recorded, the game program will be activated and the program will keep track of the jumper's mistakes and achievements. Once each turner gets the appropriate number of chances, the device will play the name of the next jumper as he/she recorded before.

Although a user selects the speed, they may want the speed to change at a given time before the actual program changes speed. For that reason, a means for the user to vary the speed remotely must be employed. Some methods include using an RF or IR transmitter and receiver system in a remote control. The user can also control the device by using voice activation through a microphone on a headset so his/her hands can be free.

A place for insertion of a CD or cassette tape can also be included for the user to play their favorite song while jumping Double Dutch.

Professional Teams Model/Competitive

Professional Double Dutch jumpers will need special features to train for competitions. In order to do tricks, the radius at which the rope is turning and the height on the machine will have to change.

Height Variation

For professional teams, features have to be implemented to allow professional jumpers to do tricks in the rope and be able to control the device to do just what they want. The conventional method involves the turners varying their height and the radius of the rope to accommodate the specific trick the jumper was executing. To simulate the motion of turners, pneumatics can be placed in the supports to control the height of the station. Using a tri-pod embodiment, each leg can contain a pneumatic. All of the stands change height linearly.

Sensors can be placed on the supports to sense when the jumper is moving doing a trick and send feedback to the microcontroller to execute code that will change the height and radius of the ropes, if necessary. As mentioned previously, an LED sensor and detector can be used to sense when the jumper has entered the rope. A similar system can determine where the jumper is throughout the entire session. Also, a method can be employed that will allow the user to record their favorite settings so that the exact speed and positioning of the ropes can be replicated for competitions and performances. Sometimes, the conventional method makes it difficult for a skilled jumper to perform at their highest potential. If the turners are absent that day or just can not seem to turn the ropes the way they had on other occasions, the jumper would not have to worry about this problem.

While doing specific tricks, the user can signal the device to record the settings. One method for doing that is to have the device show different colored lights to indicate a different setting. At the end of that particular routine, the user can go over and press the color that corresponded with the setting he or she liked and have them save the settings.

Voice activation is another means. By simply shouting a one-syllable command or any other feasible sound, an algorithm can record the RPM, device height, and distance in between so that the setting can be used again. This same technique can be employed for conditioning in speed and compulsory exercises so that consistent performance is achieved.

Radius Change

To change the radius of the rope while the rope is turning, a pneumatic device is attached to the end of the rope that employs a piston that slides in and out to change the final radius of the rope.

Methods for modifying the arc radius can be employed by using a host of means available. One example is to us a spring mechanism inserted into a tubular rope attachment piece. As a function of speed, the spring will stretch causing the radius to change to extend or contract the arm length as a function of speed. The variable length arm is intended to promote arc formation. The rope arm can hold the rope such that the arm allows the rope to swivel. The swivel mechanism prevents the rope from kinking.

Other means for varying the radius include using a worm gear and motor assembly.

Voice Control Interface

As an alternative to the traditional control panel interface, the machine can be controlled by voice interaction. When the user wishes to use the machine, they can address the machine via a unique name assigned to the machine. The machine will then query the user for the necessary information to begin jumping, ideally through speech synthesis. This enables hands free operation, as well as more natural interaction with the machine.

For instance, the user could walk up and say "Hi Alice. I'd like to jump now." The machine would respond, "Which program would you like to jump in today?" The user responds with the program number, speed, and length. The machine then starts up, freeing the user from having to use the control panel. As an added safety benefit, the user is also able to stop the machine much faster. The user can just say "Alice! Stop!" instead of having to rely on the presence of someone else to stop the machine. To ensure clarity, the jumper can use a head set with a mike, similar to that used by cellular phone owners or aerobic instructors.

The bases of the device can be designed to look like a pair of children holding the ropes. This idea can be combined with the voice interface idea by allowing the user to interact with the machine as a peer. Like Cabbage Patch Kids, no two devices would look precisely alike. They would be given a unique name in the factory, and this name is how users would interact with the machine.

Coaching

The machine can use some means of detecting height and timing of jumps to determine the quality of the user's jumps. The preferred embodiment would be something resembling Nintendo's Power Pad, using an array of Piezo elements to measure location and intensity of impact. The machine can then provide feedback such as "Jump faster," "jump slower," or "jump higher." For instance, when jumping slowly, the user will either want to jump higher than normal, or perhaps jump twice as much as is necessary in order to maintain timing.

The jump rope device could automatically adapt to user skill level, starting out slow and gradually increasing speed to ensure a constant challenge to the user.

Teaching Tools

A method for simplifying the learning process involves using special ropes. The problem with learning Double Dutch the conventional way is that the ropes cannot be turned slow enough before the ropes begin to collapse and lose the arc shape. The ropes can be replaced with a stiff yet flexible material that will take the form of an arc. Having the arcs already formed permits the device to turn at a slow enough so that a user can get a feel for how to enter the ropes and alternate their legs.

Another means for teaching can be done using no ropes at all but strictly sound and lights on a footpad. The sound and light would be in unison to convey the sound they should hear when the jumper's foot hits the ground and the light would indicate where the foot should be in that particular position.

Arc Sensing

A means for sensing the arc must be employed to detect when the ropes have formed properly. Arc formation is extremely important for using this system. It is critical to know when this happens because other functions rely on this happening first before others are executed. Methods that can be used involve electronic means. Before the ropes form the arc, they begin in a catenary position thus causing the rope to form a downward bend off the edge of the rope attachment means. When the arc forms, the rope will make an upward bend about the attachment means at which time a switch or sensor of some sort will be triggered by this change in motion. The position of that switch will always remain perpendicular to that point of contact on the rope throughout rotation so as to ensure they have formed. A certain amount of force will be exerted on that point of contact on the rope throughout rotation so as to ensure they have formed.

Multiple Units

For competitions and other large scaled events, multiple devices can be connected in such a way that the events can be standardized. One such method consists of having three units set up with two sets of ropes turning. The central device will be connected between the two devices to its left and right.

All in One System

A system to include the two stations and a jumping surface all connected can be employed so that the activity can be played anywhere. The two stations are supported on a tri-pod with one leg being in the back and the two legs being in the front in the same plane. The two legs in the front are each connected to a long tubular rod that runs along the ground to the corresponding leg of the other station. The front two legs and the parallel rod create a 135 degree angle (i.e. the tripod creates a 45 degree angle with the ground and the rod is flat on the ground). A platform appropriate for jumping such as those used in gyms and on track surfaces placed in between these two rods where the platform is rigidly attached. The back leg can be detached and the two stations can be folded down at the point where the front legs and long rod connect. A hinge connects the legs and rod so that it can fold down. Once in a fold down position, the stations will locked in place so that it doesn't flip open. The whole unit can be flipped to the side then wheeled away and stored. The wheels would be located perpendicular to the rod on one side. This system is useful for many different applications and can be used in a physical education class, ESPN Zone, or in an athletic setting.

What is claimed is:

1. A jump rope device comprising a pair of stations disposed in mirror-image facing relation to each other, each station having a pair of rotatable mechanisms for receiving and turning a pair of ropes in opposite directions to each other and a pair of motors for rotating said mechanisms;

synchronization means in each station for synchronizing the rotation of said rotatable mechanisms; and electronic means in each station for controlling the speed of rotation of each rotatable mechanism.

2. A jump rope device as set forth in claim 1 wherein said synchronization means includes a pair of gears, each gear being disposed in a respective motor of at least one of said stations and having a hole therein to indicate a position of said respective motor; a pair of photogates, each photogate being positioned for sensing the passage of said hole in a respective gear during rotation of said respective motor and gear and emitting a corresponding signal indicative thereof; and a microcontroller operatively connected to each said photogate to receive said signal and for turning said motors relative to each other into a fixed relative synchronized position.

3. A jump rope device as set forth in claim 1 wherein said electronic means includes a dual closed loop control system.

4. A jump rope device as set forth in claim 1 wherein each motor is a DC motor.

5. A jump rope device as set forth in claim 1 which further comprises an electronic means for setting up a modulated infrared beam between said stations, and a microchip for monitoring said beam and being operatively connected to said motors to deactivate said motors in response to a detection of an interruption in said beam.

6. A jump rope device as set forth in claim 1 which further comprises a remote control safety switch for use by a user to deactivate said motors.

7. A jump rope device as set forth in claim 1 wherein each station includes a housing having said pair of motors therein and a collapsible tripod support supporting said housing thereon.

8. A jump rope device as set forth in claim 7 wherein each station includes means for anchoring said tripod support to a floor.

9. A jump rope device as set forth in claim 8 wherein said means for anchoring includes a suction cup for engaging a floor and a turnbuckle securing said suction cup to said tripod support.

* * * * *